US010046939B2

(12) United States Patent
Nishimura et al.

(10) Patent No.: US 10,046,939 B2
(45) Date of Patent: Aug. 14, 2018

(54) SHEET PROCESS APPARATUS AND CONTROL METHOD THEREOF

(71) Applicant: Horizon International Inc., Shiga (JP)

(72) Inventors: Kohei Nishimura, Shiga (JP); Takehito Yokogi, Shiga (JP)

(73) Assignee: Horizon International Inc., Shiga (JP)

( * ) Notice: Subject to any disclaimer, the term of this patent is extended or adjusted under 35 U.S.C. 154(b) by 0 days.

(21) Appl. No.: 15/738,184

(22) PCT Filed: Aug. 5, 2015

(86) PCT No.: PCT/JP2015/072240

§ 371 (c)(1),
(2) Date: Dec. 20, 2017

(87) PCT Pub. No.: WO2017/022100

PCT Pub. Date: Feb. 9, 2017

(65) Prior Publication Data

US 2018/0179014 A1 Jun. 28, 2018

(51) Int. Cl.

| | |
|---|---|
| ***B65H 39/10*** | (2006.01) |
| ***B26D 5/32*** | (2006.01) |
| ***B26D 5/00*** | (2006.01) |
| ***B65H 43/08*** | (2006.01) |

(Continued)

(52) U.S. Cl.

CPC ..... *B65H 39/10* (2013.01); *B26D 5/007* (2013.01); *B26D 5/32* (2013.01); *B26D 7/32* (2013.01);

(Continued)

(58) Field of Classification Search

CPC ..... B65H 35/02; B65H 39/10; B65H 43/08; B65H 45/14; B65H 2511/512; B26D 5/007; B26D 5/32; B26D 7/32; B26D 2007/322

(Continued)

(56) References Cited

U.S. PATENT DOCUMENTS 5,726,435 A * 3/1998 Hara ..... G06K 7/14 235/462.09
5,823,692 A * 10/1998 Tolrud ..... B26D 5/34 400/582

(Continued)

FOREIGN PATENT DOCUMENTS

JP 7-254037 10/1995
JP 2001-232700 8/2001

(Continued)

OTHER PUBLICATIONS

Espacenet machine translation of JP2001232700; obtained Apr. 3, 2018; http://translationportal.epo.org/emtp/translate/?ACTION=description-retrieval&COUNTRY=JP&ENGINE=google&FORMAT=docdb&KIND=A&LLOCALE=en_EP&NUMBER=2001232700&OPS=ops.epo.org/3.2&SRCLANG=ja&TRGLANG=en.*

(Continued)

*Primary Examiner* — Leslie A Nicholson, III
(74) *Attorney, Agent, or Firm* — Kirschstein, Israel, Schiffmiller & Pieroni, P.C.

(57) ABSTRACT

A sheet process apparatus images a code printed on a fed sheet, and a control unit acquires image data of the imaged code, reads information of the code from the image data, measures a real position of the code from the image data, retrieves position information corresponding to the read information of the code, calculates an amount of deviation between the measured real position of the code and a reference position, corrects the position information on the basis of the amount of the calculated deviation so as to determine a target position, and outputs the target position. The apparatus and corresponding method do not need the sheet to have a wide space for printing both a cut mark and the code, and do not recognize another mark as the cut mark.

8 Claims, 9 Drawing Sheets

(51) Int. Cl.
*B65H 45/14* (2006.01)
*B26D 7/32* (2006.01)

(52) U.S. Cl.
CPC ..... *B65H 43/08* (2013.01); *B65H 45/14* (2013.01); *B26D 2007/322* (2013.01)

(58) Field of Classification Search
USPC ..... 270/45, 52.02, 58.04, 58.07; 700/225
See application file for complete search history.

(56) References Cited

U.S. PATENT DOCUMENTS

| | | | | |
|---|---|---|---|---|
| 6,976,161 | B2 * | 12/2005 | Nelson | H04N 1/00 235/375 |
| 7,055,418 | B2 * | 6/2006 | Maddalon | B26D 5/32 83/364 |

FOREIGN PATENT DOCUMENTS

| | | |
|---|---|---|
| JP | 2007-226411 | 9/2007 |
| JP | 2009-028860 | 2/2009 |
| JP | 2009-154229 | 7/2009 |

OTHER PUBLICATIONS

Espacenet machine translation of JP2009028860; obtained Apr. 3, 2018; http://translationportal.epo.org/emtp/translate/?ACTION=description-retrieval&COUNTRY=JP&ENGINE=google&FORMAT=docdb&KIND=A&LOCALE=en_EP&NUMBER=2009028860&OPS=ops.epo.org/3.2&SRCLANG=ja&TRGLANG=en.*

International search report dated Oct. 14, 2015 mailed in corresponding international application No. PCT/JP2015/072240.

* cited by examiner

SHEET PROCESS APPARATUS AND CONTROL METHOD THEREOF

TECHNICAL FIELD OF THE INVENTION

The present invention relates to a sheet process apparatus and a control method thereof, particularly the apparatus includes a feed unit that feeds a plurality of sheets one-by-one; and a process unit that processes one-by-one the sheets fed by the feed unit.

BACKGROUND OF THE INVENTION

There is a conventional sheet cut apparatus. The apparatus includes a feed unit that feeds a plurality of sheets one-by-one; and a slitter unit that slits one-by-one the sheets fed by the feed unit. In the apparatus disclosed by the following Patent Document 1, the slitter unit includes a margin slitter 32 and center slitters 36 and 38 (hereinafter, see the Patent Document 1 as to reference numbers). The sheet 1 includes a cut mark 2 and a bar code 3 printed on a surface thereof.

The apparatus includes a CCD camera 29 that images the cut mark 2 and the bar code 3 on the sheet 1. The margin slitter 32 and the center slitters 36 and 38 are transferred toward a predetermined position on the basis of information of the bar code 3 imaged by the CCD camera 29. Positions of the margin slitter 32 and the center slitters 36 and 38 are adjusted respectively on the basis of an amount of deviation calculated between a real position of the cut mark 2 imaged by the CCD camera 29 and a reference position.

As described above, in the conventional apparatus, both of the cut mark 2 and the bar code 3 should be printed on the sheet 1. Thus, the sheet 1 should have a wide space for printing both the cut mark 2 and the bar code 3. The CCD camera 29 recognizes another mark printed on the sheet 1 as the cut mark 2 by mistake in case that the another mark is similar to the cut mark 2 because the cut mark 2 has a simple shape.

Patent Document 1: JP 2001-232700 A

SUMMARY OF THE INVENTION

Problems to be Solved by the Invention

It is an object of the present invention to provide a sheet process apparatus and method thereof that does not need the sheet comprising the wide space for printing both the cut mark and the bar code, and that does not recognize another mark as the cut mark.

Solution to the Problems

In order to achieve the object, the present invention provides a sheet process apparatus. The sheet process apparatus, comprising a feed unit configured to feed a plurality of sheets one-by-one; and a process unit configured to process one-by-one the sheets fed by the feed unit. The sheet comprises a one or two-dimensional code printed on a first or second surface thereof. The process unit comprises a process mechanism configured to conduct a predetermined process for the sheet; and a transfer mechanism configured to transfer the process mechanism. The sheet process apparatus further comprises a memory configured to store both a plurality of position information on the process mechanism and a reference position of the code; a camera configured to image the code printed on the sheet fed by the feed unit; and a control unit configured to control an operation of the transfer mechanism. The control unit comprises an acquisition part configured to acquire an image data of the code imaged by the camera; a read part configured to read information of the code from the image data acquired by the acquisition part; a position measure part configured to measure a real position of the code from the image data acquired by the acquisition part; a retrieval part configured to retrieve the position information corresponding to the information of the code read by the acquisition part, from a plurality of the position information on the process mechanism stored in the memory; a calculation part configured to calculate an amount of deviation between the real position of the code measured by the position measure part and the reference position of the code stored in the memory; a determination part configured to correct the position information on the process mechanism retrieved by the retrieval part on the basis of the amount of deviation calculated by the calculation part so as to determine a target position of the process mechanism; and a target position output part configured to output the target position of the process mechanism determined by the determination part toward the transfer mechanism. The transfer mechanism transfers the process mechanism toward the target position of the process mechanism output from the target position output part.

According to a preferable embodiment of the sheet process apparatus, the position measure part comprises an outline recognition part configured to recognize an outline of the code on the basis of the image data; and a coordinate measure part configured to measure a coordinate of predetermined one point on the outline of the code recognized by the outline recognition part.

According to a preferable embodiment of the sheet process apparatus, the predetermined one point is disposed on one corner of the outline of the code. The coordinate measure part is configured to sub-pixel process the image data acquired by the acquisition part within limited area of the one corner so as to measure a coordinate of the corner.

According to a preferable embodiment of the sheet process apparatus, the position measure part comprises an angle measure part configured to measure an angle of a line connected with predetermined two points on the outline of the code recognized by the outline recognition part; a judge part configured to judge whether the angle measured by the angle measure part is more than a predetermined angle; and a stop signal output part configured to output a signal for stopping the sheet process apparatus when the judge part judges that the angle is more than the predetermined angle.

According to a preferable embodiment of the sheet process apparatus, the predetermined two points are disposed on two corners of the outline of the code. The angle measure part is configured to sub-pixel process the image data acquired by the acquisition part within limited areas of the two corners so as to measure the angle of the line connected with the two corners.

According to a preferable embodiment of the sheet process apparatus, the sheet process apparatus is composed of a sheet cut apparatus. The process mechanism comprises a slitter.

According to a preferable embodiment of the sheet process apparatus, the sheet process apparatus is composed of a sheet fold apparatus. The process mechanism comprises a stopper disposed on a buckle.

In order to achieve the object, the present invention provides a control method for a sheet process apparatus. The sheet process apparatus comprises a feed unit configured to feed a plurality of sheets one-by-one; and a process unit configured to process one-by-one the sheets fed by the feed unit. The sheet comprises a one or two-dimensional code printed on a first or second surface thereof. The process unit comprises a process mechanism configured to conduct a predetermined process for the sheet; and a transfer mechanism configured to transfer the process mechanism. The sheet process apparatus further comprises a memory configured to store both a plurality of position information on the process mechanism and a reference position of the code; a camera configured to image the code printed on the sheet fed by the feed unit; and a control unit configured to control an operation of the transfer mechanism. The control method comprises a first step of acquiring an image data of the code imaged by the camera; a second step of reading information of the code from the image data acquired by the first step; a third step of measuring a real position of the code from the image data acquired by the first step; a fourth step of retrieving the position information corresponding to the information of the code read by the second step, from a plurality of the position information on the process mechanism stored in the memory; a fifth step of calculating an amount of deviation between the real position of the code measured by the third step and the reference position of the code stored in the memory; a sixth step of correcting the position information on the process mechanism retrieved by the fourth step on the basis of the amount of deviation calculated by the fifth step so as to determine a target position of the process mechanism; a seventh step of outputting the target position of the process mechanism determined by the sixth step toward the transfer mechanism; and an eighth step of transferring the process mechanism toward the target position of the process mechanism output from the target position output part outputted by the seventh step.

According to a preferable embodiment of the control method for the sheet process apparatus, the third step comprises a tenth step of recognizing an outline of the code on the basis of the image data; and an eleventh step of measuring a coordinate of predetermined one point on the outline of the code recognized by the tenth step.

According to a preferable embodiment of the control method for the sheet process apparatus, the predetermined one point is disposed on one corner of the outline of the code. The eleventh step is configured to sub-pixel process the image data acquired by the first step within limited area of the one corner so as to measure a coordinate of the corner.

According to a preferable embodiment of the control method for the sheet process apparatus, the third step comprises a twelfth step of measuring an angle of a line connected with predetermined two points on the outline of the code recognized by the tenth step; a thirteenth step of judging whether the angle measured by the twelfth step is more than a predetermined angle; and a fourteenth step of outputting a signal for stopping the sheet process apparatus when the judge part judges that the angle is more than the predetermined angle in the thirteenth step.

According to a preferable embodiment of the control method for the sheet process apparatus, the predetermined two points are disposed on two corners of the outline of the code. The twelfth step is configured to sub-pixel process the image data acquired by the first step within limited areas of the two corners so as to measure the angle of the line connected with the two corners.

According to a preferable embodiment of the control method for the sheet process apparatus, the sheet process apparatus is composed of a sheet cut apparatus. The process mechanism comprises a slitter.

According to a preferable embodiment of the control method for the sheet process apparatus, the sheet process apparatus is composed of a sheet fold apparatus. The process mechanism comprises a stopper disposed on a buckle.

Effect of the Invention

As above described, in the present invention of the sheet process apparatus and the method thereof, the one or two-dimensional code only has to be printed on the sheet. Thus, the sheet does not need to include the wide space for printing both the cut mark and the bar code.

Further, the apparatus and the method calculates the amount of deviation between the real position of the one or two-dimensional code and the reference position of the code. The position of the code can be recognized certainly because the one or two-dimensional code has a very distinguishing shape. Thus, another mark cannot be recognized as the code even though the image data imaged by the camera includes another mark. Therefore, the apparatus and the method can calculate the amount of deviation correctly.

Furthermore, the apparatus and the method images only the one or two-dimensional code using the camera so as to control the operation of the apparatus using the control unit. Thus, the apparatus and the method can control the operation of the apparatus easily and rapidly compared with the conventional apparatus imaging both the cut mark and the bar code.

DETAILED EXPLANATION OF THE PREFERRED EMBODIMENTS

A sheet process apparatus and a control method thereof according to the present invention will be explained below with reference to the drawings.

Figure 1:
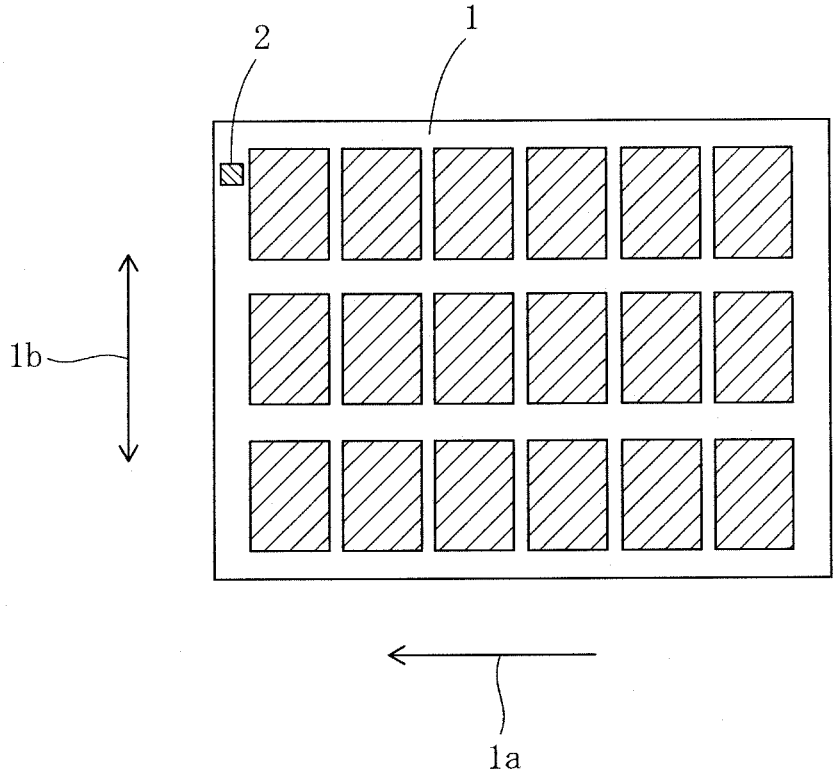
FIG. 1 is a plan view showing an embodiment of a sheet comprising a one or two-dimensional code.

As shown in FIG. 1, a sheet 1 has a rectangular shape with a long side extending in a feed direction 1*a* and a short side extending in a direction 1*b* at right angle to the feed direction 1*a*. The sheet 1 includes a two dimensional code 2 printed on a front portion of the feed direction 1*a* of a first surface thereof. The code 2 is printed on a margin of the sheet 1 to be discarded after cutting the sheet 1. The sheet 1 may include a one dimensional code 2 printed on a second surface thereof.

Figure 2:
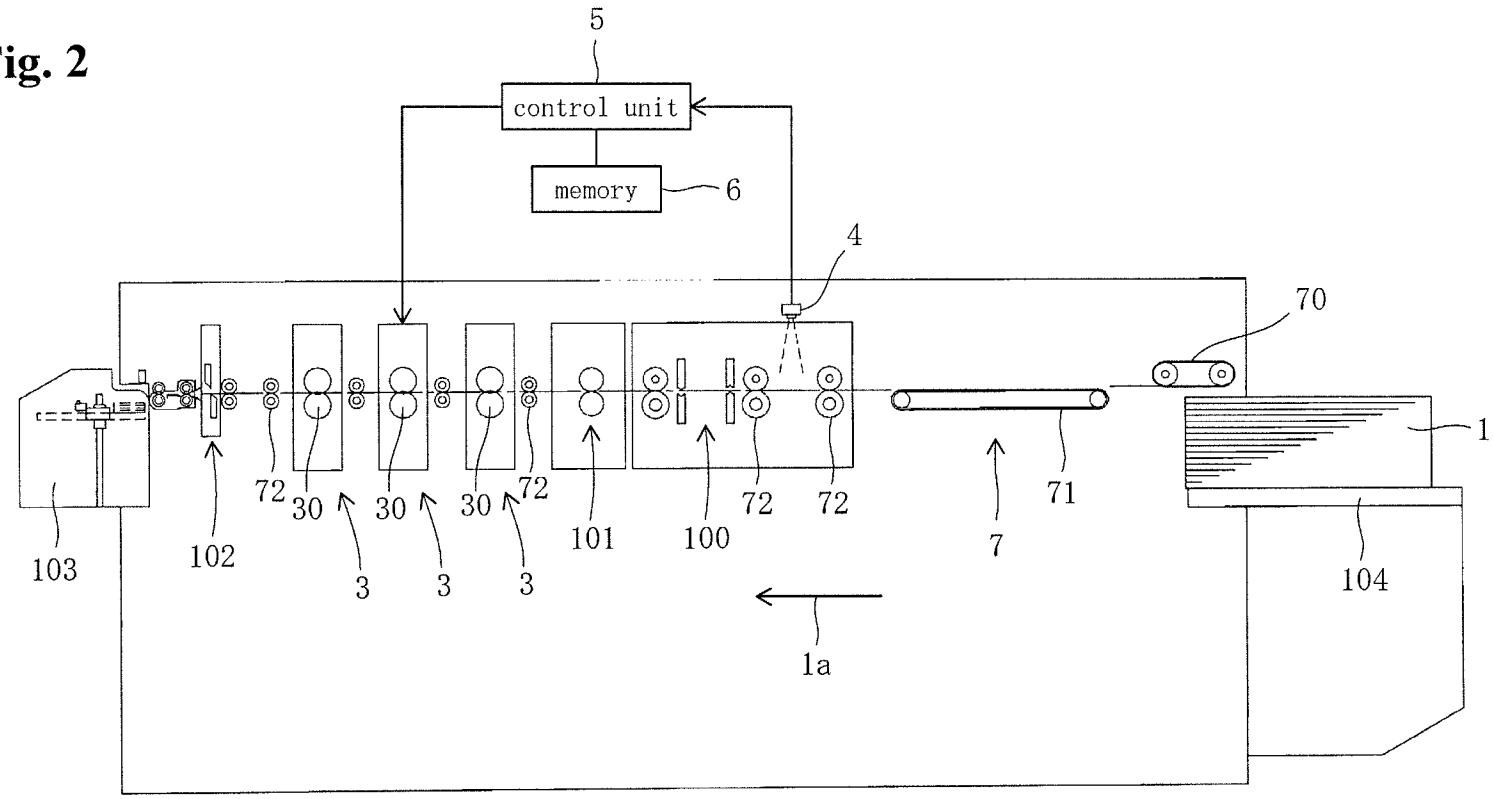
FIG. 2 is a side view showing a sheet cut apparatus.
Figure 3:
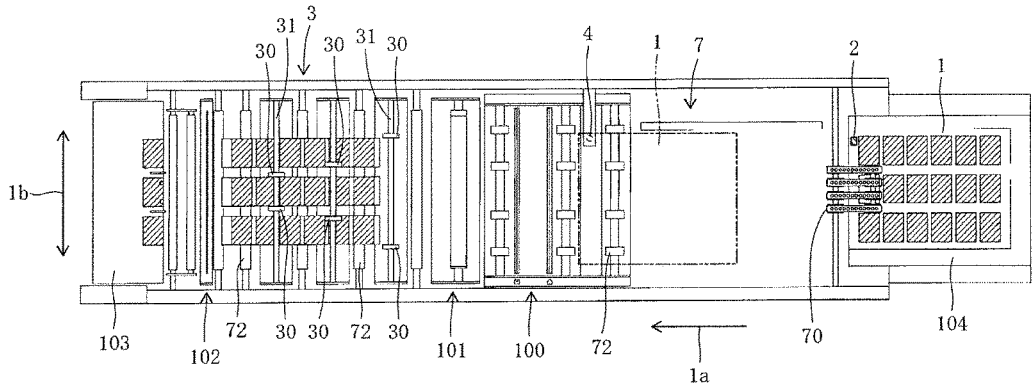
FIG. 3 is a plan view showing the sheet cut apparatus.

As shown in FIGS. 2 and 3, in this embodiment, the sheet process apparatus is composed of a sheet cut apparatus that cuts the sheet 1. The sheet cut apparatus includes a stacker 104 that stacks a plurality of the sheets 1 before cut. The sheet cut apparatus includes a feed unit 7 that feeds the sheets 1 one-by-one in the feed direction 1*a*. The feed unit 7 includes a suction conveyer 70 that suctions one-by-one the sheets 1 stacked on the stacker 104 so as to feed them in the feed direction 1*a*. The feed unit 7 includes a belt conveyer 71 that guides and feeds the sheets 1 fed from the suction conveyer 70 in the feed direction 1*a*.

The sheet cut apparatus includes a plurality of process units 3, 100, 101 and 102 that processes one-by-one the sheets 1 fed by the feed unit 7. The feed unit 7 includes a plurality of a pair of feed rollers 72 that nips and feeds the sheets 1 toward each of the process units 3, 100, 101 and 102. The process unit 101 is composed of a crease form unit that forms a crease extending in the right angle direction 1*b* on the sheet 1. The process unit 102 is composed of a cutter unit that cuts the sheets 1 in the right angle direction 1*b*.

The process unit 3 is composed of a slitter unit that slits the sheets 1 in the feed direction 1*a*. The sheet cut apparatus includes a stacker 103 that stacks the sheets 1 processed by each of the process units 3, 100, 101 and 102. The sheet cut apparatus includes a CCD camera 4 that images the codes 2 printed on the sheets 1 one-by-one before the sheets 1 is processed by each of the process units 3, 100, 101 and 102. As shown in FIG. 3, after the sheet 1 stops at a predetermined position by the feed unit 7, the camera 4 images the code 2 of the stopped sheet 1. The sheet cut apparatus includes a control unit 5 that controls operations of the feed unit 7 and each of the process units 3, 100, 101 and 102. The control unit 5 is composed of a microcomputer that comprises RAM, ROM, CPU, and so on.

Figure 4:
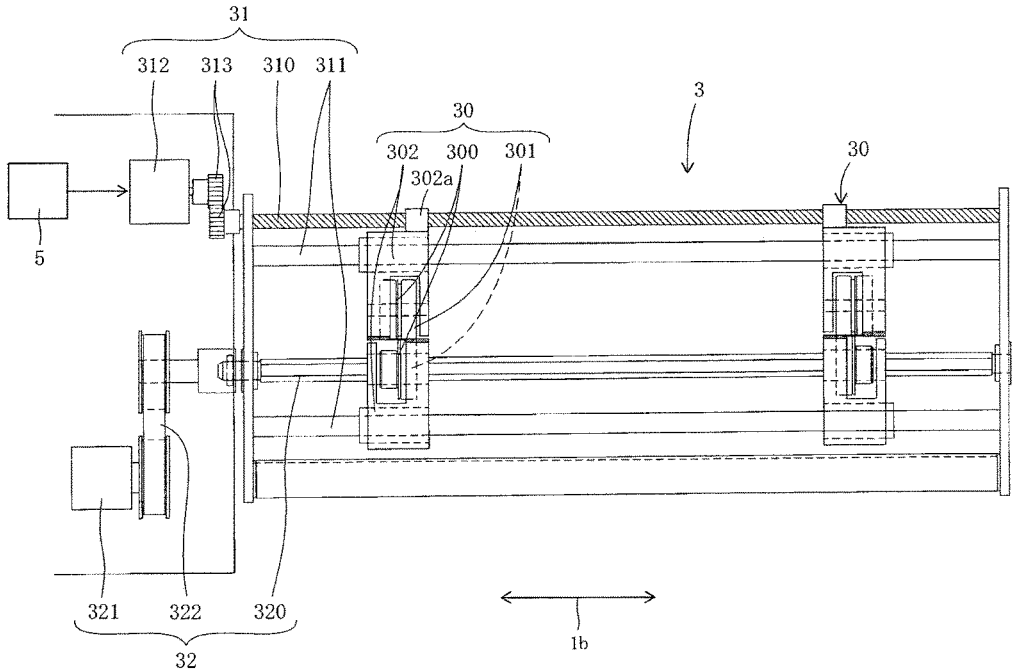
FIG. 4 is a front view showing a process mechanism and a transfer mechanism.

As shown in FIGS. 2 and 3, the sheet cut apparatus includes three slitter units 3 arranged along the feed direction 1*a*. As shown in FIG. 4, each of the slitter units 3 includes process mechanisms 30 that conduct a predetermined process for the sheet 1. The process mechanisms 30 are spaced from each other at a predetermined interval. Each of the process mechanisms 30 comprises a pair of circular slitters 300 disposed vertically; a pair of rollers 301 attached to each of the slitters 300; and a pair of supporters 302 supporting the slitters 300 and the rollers 301.

The slitter unit 3 includes a transfer mechanism 31 that transfers the process mechanism 30. The transfer mechanism 31 includes a feed screw 310 extending in the right angle direction 1*b*. The transfer mechanism 31 includes a servomotor 312 that rotates the feed screw 310. The transfer mechanism 31 includes gears 313 that transmit an output of the servomotor 312 to the feed screw 310. The transfer mechanism 31 includes a pair of guide bars 311 parallel to the feed screw 310. The supporter 302 is capable of sliding on the guide bar 311 and includes a nut 302*a* engaged with the feed screw 310 on an upper portion thereof. Thus, the process mechanisms 30 and 30 are moved in the right angle direction 1*b* by clockwise and counterclockwise revolutions of the feed screw 310.

The slitter unit 3 includes a drive mechanism 32 that drives the process mechanism 30. The drive mechanism 32 includes a spline 320 extending in the right angle direction 1*b*. The drive mechanism 32 includes a servomotor 321 that rotates the spline 320. The drive mechanism 32 includes a belt 322 that transmits an output of the servomotor 321 to the spline 320. The spline 320 is engaged with a lower roller 301 of the process mechanism 30. Thus, the lower roller 301 of the process mechanism 30 rotates by a revolution of the spline 320. The revolution of the lower roller 301 rotates an upper roller 301 contacted with the lower roller 301 so as to rotate the slitter 300 attached to each of the rollers 301.

Figure 5:
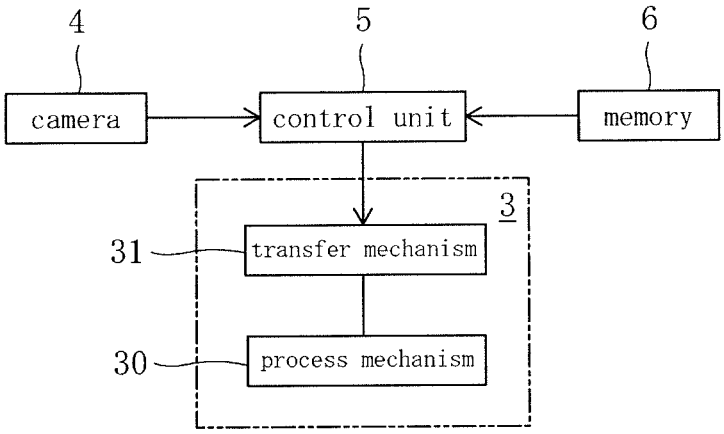
FIG. 5 is a view showing a structure of the sheet process apparatus.

As shown in FIG. 5, the sheet cut apparatus includes a memory 6 connected with a control unit 5. The control unit 5 controls an operation of the transfer mechanism 31 (servomotor 312). The memory 6 stores both a plurality of position information (D1, D2 . . . Dn) on the process mechanism 30 and a reference position (R) of the code 2.

Figure 6:
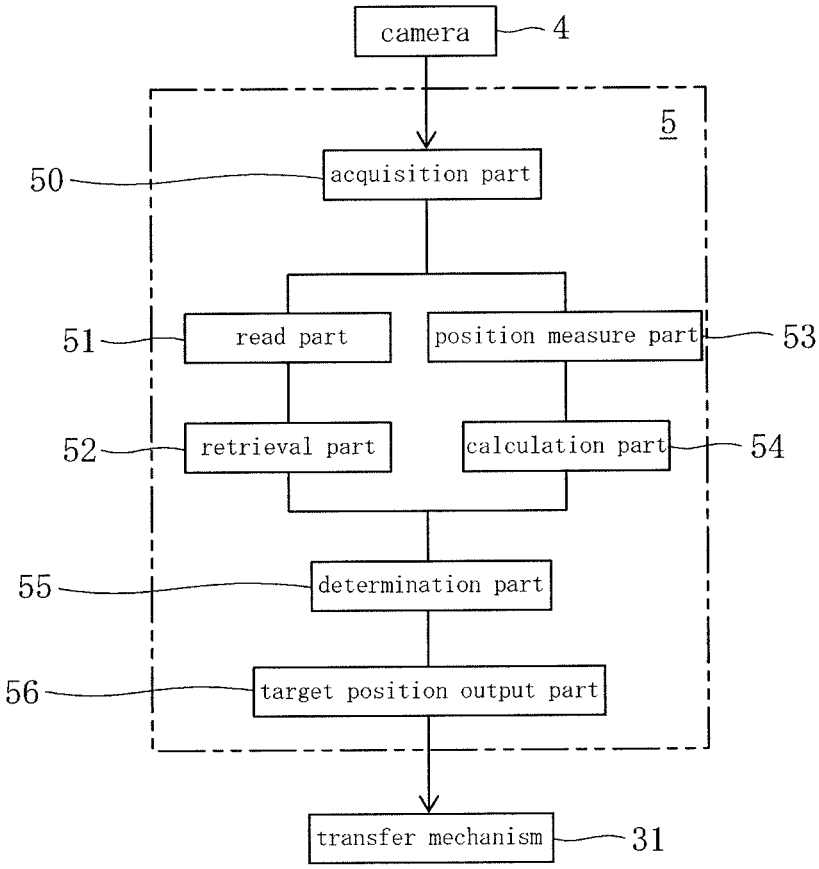
FIG. 6 is a view showing a structure of a control unit.

As shown in FIG. 6, the control unit 5 includes an acquisition part 50 that acquires an image data of the code 2 imaged by the camera 4. The control unit 5 includes a read part 51 that reads information of the code 2 from the image data acquired by the acquisition part 50. The control unit 5 includes a retrieval part 52 that retrieves the position information (Dm) corresponding to the information (D) of the code 2 read by the acquisition part 51, from a plurality of the position information (D1, D2 . . . Dn) on the process mechanism 30 stored in the memory 6.

The control unit 5 includes a position measure part 53 that measures a real position of the code 2 from the image data acquired by the acquisition part 50. The control unit 5 includes a calculation part 54 that calculates an amount of deviation (g) between the real position (P) of the code 2 measured by the position measure part 53 and the reference position (R) of the code 2 stored in the memory 6.

The control unit 5 includes a determination part 55 that corrects the position information (Dm) on the process mechanism 30 retrieved by the retrieval part 52 on the basis of the amount of deviation (g) calculated by the calculation part 54 so as to determine a target position (T) of the process mechanism 30. The control unit 5 includes a target position output part 56 that outputs the target position (T) of the process mechanism 30 determined by the determination part 55 toward the transfer mechanism 31. The transfer mechanism 31 (servomotor 312) transfers the process mechanism 30 toward the target position (T) of the process mechanism 30 output from the target position output part 56.

Figure 7:
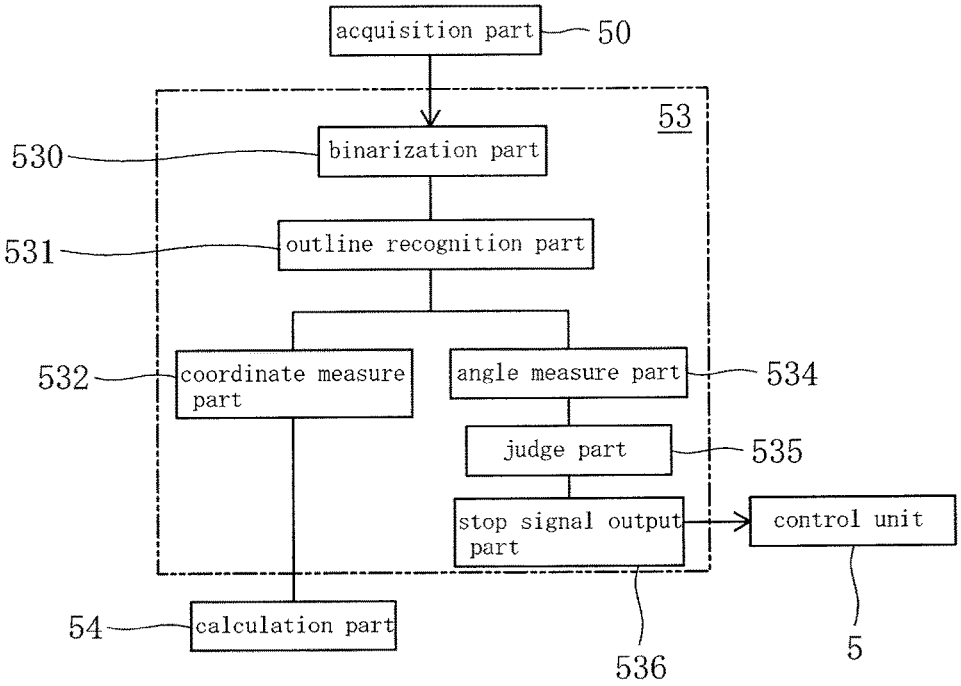
FIG. 7 is a view showing a structure of a position measure part.
Figure 8A:
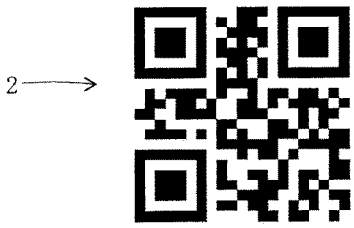
FIGS. 8A, 8B, 8C, and 8D are views showing a two dimensional code to be measured by the position measure part.
Figure 8B:
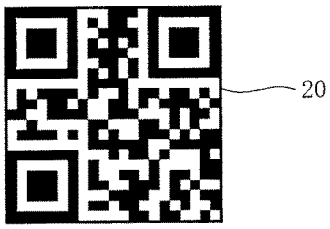
Figure 8C:
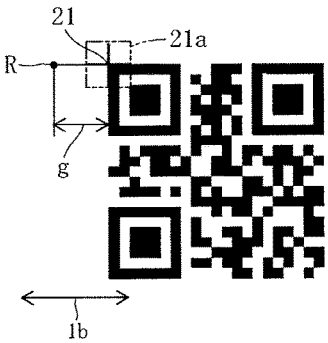

As shown in FIG. 7, the position measure part 53 includes a binarization part 530 that binarizes the image data acquired by the acquisition part 50. FIG. 8A shows the binarized code 2. The position measure part 53 includes an outline recognition part 531 that recognizes an outline 20 of the code 2 (see FIG. 8B) on the basis of the image data binarized by the binarization part 530. The position measure part 53 includes a coordinate measure part 532 that sub-pixel processes the image data acquired by the acquisition part 50 within limited area 21*a*. The area 21*a* is around the one corner 21 of the outline 20 of the code 2 recognized by the outline recognition part 531. The coordinate measure part 532 then measures a coordinate of the one corner 21 of the outline 20 of the code 2. The sub-pixel process can measure the coordinate of the corner 21 with high accuracy, but not at high speed. Thus, it is preferable to sub-pixel process the corner 21 within minimum limited area 21*a* smaller than the code 2 so as to increase the performance speed. Then, the calculation part 54 calculates the amount of deviation (g) in the right angle direction 1*b* between the real position (P) of the corner 21 and the reference position (R). The coordinate of the corner 21 is measured in this embodiment, but the coordinate of a predetermined point on the outline 20 of the code 2 may be measured in another embodiment. When the predetermined point is disposed on the corner 21, the performance speed can be increased because an extra calculation is not needed.

Figure 8D:
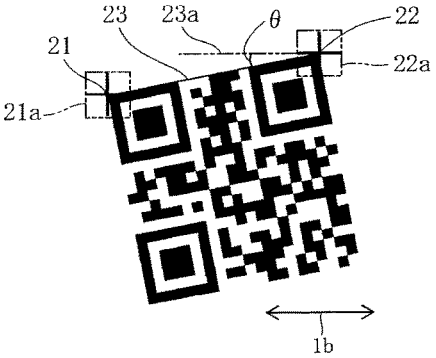

As shown in FIG. 7, the position measure part 53 further includes an angle measure part 534. The angle measure part 534 sub-pixel processes the image data acquired by the acquisition part 50 within limited areas 21*a* and 22*a*. The areas 21*a* and 22*a* are around two corners 21 and 22 of the outline 20 of the code 2 recognized by the outline recognition part 531. Then, the angle measure part 534 measures an angle θ (see FIG. 8D) between a line 23 connected with two corners 21 and 22 of the code 2 and a reference line 23*a* extending in the right angle direction 1*b*. The sub-pixel process can measure the coordinate of corners 21 and 22 with high accuracy, but not at high speed. Thus, it is preferable to sub-pixel process the corner 21 within minimum limited areas 21*a* and 22*a* smaller than the code 2 so as to increase the performance speed. The coordinate of the corners 21 and 22 are measured in this embodiment, but the coordinate of two predetermined points on the outline 20 of the code 2 may be measured in another embodiment. When the two predetermined points are disposed on the corners 21 and 22, the performance speed can be increased because an extra calculation is not needed.

The position measure part 53 further includes a judge part 535 that judges whether the angle θ measured by the angle measure part 534 is more than a predetermined angle. The position measure part 53 further includes a stop signal output part 536 that outputs a signal for stopping the sheet cut apparatus when the judge part 535 judges that the angle θ is more than the predetermined angle. When the sheet 1 fed by the feed unit 7 is inclined at an angle more than the predetermined angle, the apparatus cannot perform the sheet 1 appropriately. Thus, it is possible to prevent the apparatus from processing the sheet 1 appropriately by stopping the apparatus on the basis of the signal from the stop signal output part 536.

Figure 9:
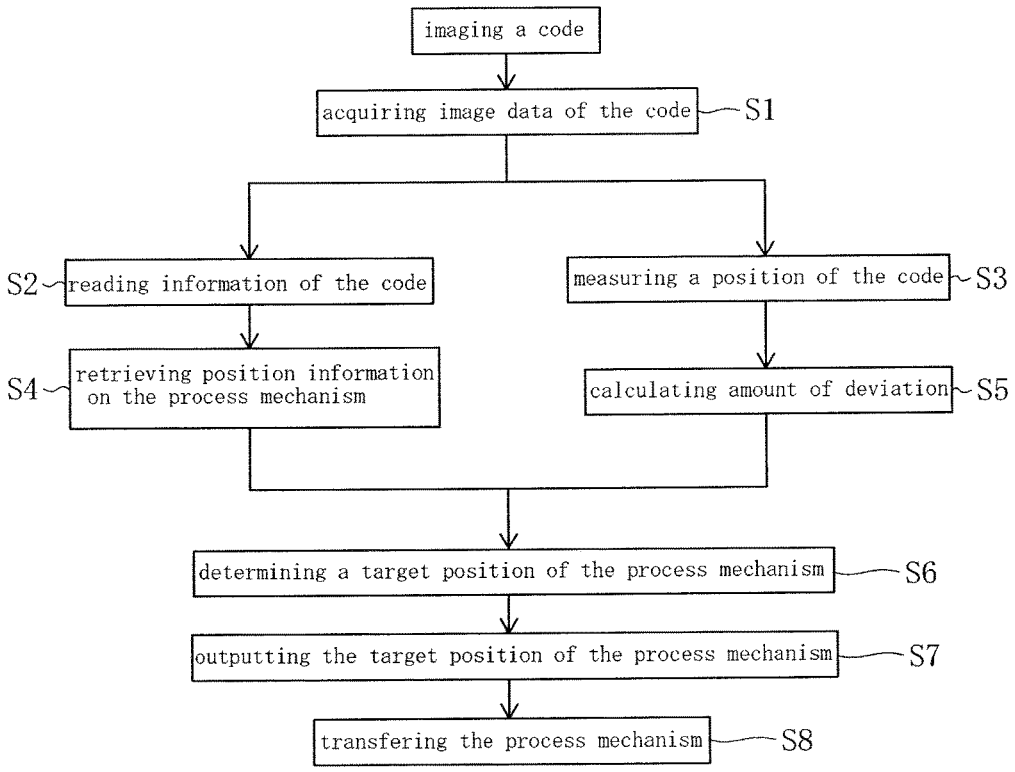
FIG. 9 is a flowchart for describing a control method.

Next, the control method of the sheet cut apparatus will be explained. As shown in FIG. 9, the control unit 5 controls an operation of the transfer mechanism 31 (the servomotor 312) on the basis of following first to eighth steps S1 to S8. The control unit 5 acquires the image data imaged by the camera 4 (first step S1). Then, the control unit 5 reads the information of the code 2 from the image data acquired by the first step S1 (second step S2). The control unit 5 further measures the position of the code 2 from the image data acquired by the first step S (third step S3).

The control unit 5 retrieves the position information (Dm) corresponding to the information (D) of the code 2 read by the acquisition part 51, from a plurality of the position information (D1, D2 . . . Dn) on the process mechanism 30 stored in the memory 6 (fourth step S4). The control unit 5 calculates the amount of deviation (g) between the real position (P) of the code 2 measured by the third step S3 and the reference position (R) of the code 2 stored in the memory 6 (fifth step S5).

The control unit 5 corrects the position information (Dm) on the process mechanism 30 retrieved by the fourth step S4 on the basis of the amount of deviation (g) calculated by the fifth step S5 so as to determine a target position (T) of the process mechanism 30 (sixth step S6). The control unit 5 outputs the target position (T) of the process mechanism 30 determined by the sixth step S6 toward the transfer mechanism 31 (seventh step S7). The control unit 5 transfers the process mechanism 30 by the transfer mechanism 31 (servomotor 312) toward the target position (T) of the process mechanism 30 output by the seventh step S7 (eighth step S8).

Figure 10:
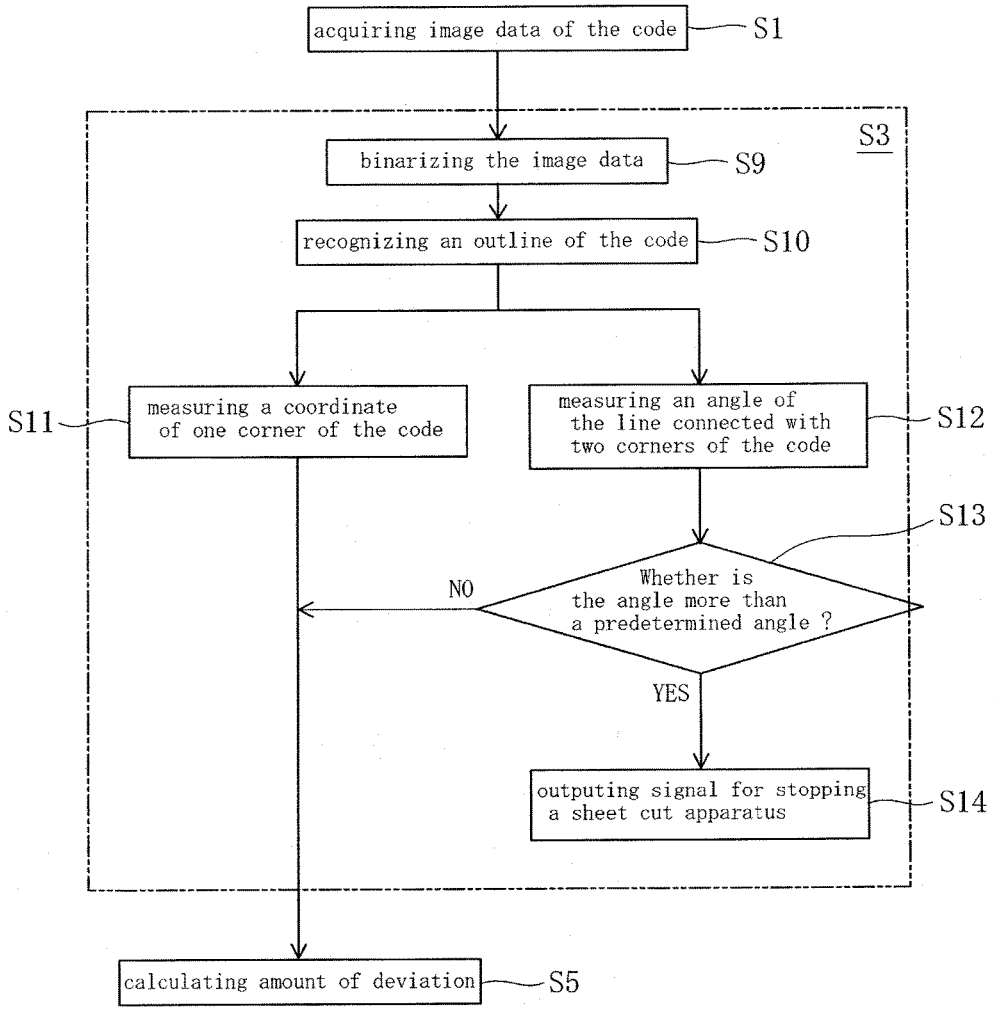
FIG. 10 is a flowchart for describing the control method.

As shown in FIG. 10, the third step S3 further includes following ninth to eleventh steps S9 to S11. The control unit 5 binarizes the image data acquired by the first step S1 (ninth step S9). The control unit 5 recognizes the outline 20 of the code 2 on the basis of the image data binarized by the ninth step S9 (tenth step S10). The control unit 5 sub-pixel processes the image data acquired by the first step S1 within limited area 21*a*. The area 21*a* is around the one corner 21 of the outline 20 of the code 2 recognized by the tenth step S10. The control unit 5 measures the coordinate of the one corner 21 of the outline 20 of the code 2 (eleventh step S11).

As shown in FIG. 10, the third step S3 further includes following ninth to eleventh steps S9 to S11. The control unit 5 sub-pixel processes the image data acquired by the first step S1 within limited areas 21*a* and 22*a*. The areas 21*a* and 22*a* are around two corners 21 and 22 of the outline 20 of the code 2 recognized by the tenth step S10. The control unit 5 then measures an angle θ of the line 23 connected with the two corners 21 and 22 of the code 2 (twelfth step S12). The control unit 5 judges whether the angle θ measured by the twelfth step S12 is more than the predetermined angle (thirteenth step S13). The control unit 5 outputs the signal for stopping the sheet cut apparatus when the thirteenth step S13 judges that the angle θ is more than the predetermined angle (fourteenth step S14).

Another Embodiments

Figure 11:
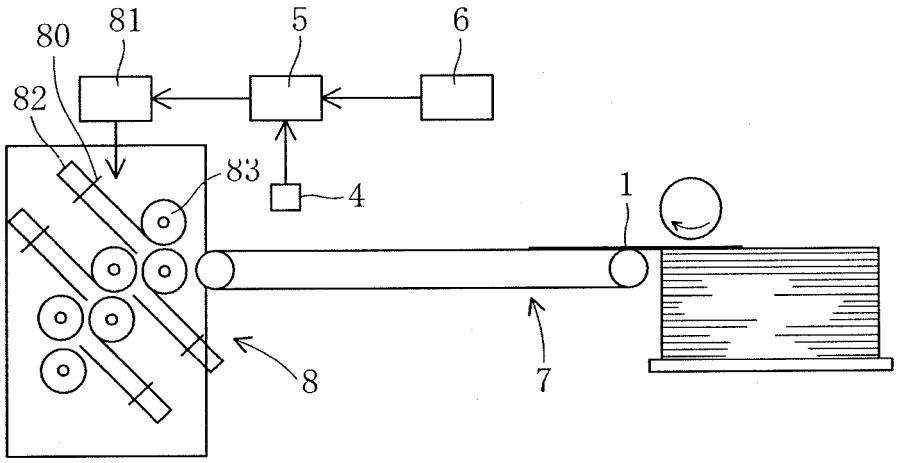
FIG. 11 is a side view showing a sheet fold apparatus.

Next, another embodiment of the sheet process apparatus will be explained below. Detailed explanation about the same structures as in the above embodiment is omitted. As shown FIG. 11, in another embodiment, the sheet process apparatus is composed of a sheet fold apparatus for folding the sheet 1. The sheet fold apparatus includes a process unit 8 that processes one-by-one the sheet 1 fed by a feed unit 7. The process unit 8 is composed of a fold unit. The fold unit 8 includes a plurality of buckles 82; stoppers (process mechanisms) 80 disposed on each of the buckles 82; and rollers 83 disposed between each of the buckles 82. The fold unit 8 includes a transfer mechanism 81 that transfers the buckles 82. The transfer mechanism 81 is, similarly to the above embodiment, composed of a feed screw, a servomotor and so on. The control unit 5 controls an operation of the transfer mechanism 81 on the basis of an image data of the code 2 imaged by a camera 4 so as to transfer the stoppers (process mechanism) 80 along the buckles 82 toward a target position (T).

Preferable embodiments of the present invention are explained, but the structural features of the present invention are not limited to this embodiment. For example, the sheet process apparatus may be composed of a sheet crease apparatus, a perfect book binding apparatus and so on.

DESCRIPTION OF THE REFERENCE CHARACTERS

1 sheet
2 one or two-dimensional code
21, 22 corner
21*a*, 22*a* limited area
3, 8 process unit (slitter unit) (fold unit)
30, 80 process mechanism (slitter) (stopper)
31, 81 transfer mechanism
4 camera
5 control unit
50 acquisition part
51 read part
52 retrieval part
53 position measure part
530 binarization part
531 outline recognition part
532 coordinate measure part
534 angle measure part
535 judge part
536 stop signal output part
54 calculation part

55 determination part
56 target position output part
6 memory
7 feed unit
D1, D2 . . . Dn, Dm position information
R reference position of the code
P real position of the code
g amount of deviation
T target position of the process mechanism

The invention claimed is:

1. A sheet process apparatus, comprising:
a feed unit configured to feed a plurality of sheets one-by-one; and
a process unit configured to process one-by-one the sheets fed by the feed unit;
wherein the sheet comprises:
a one or two-dimensional code printed on a first or second surface thereof;
wherein the process unit comprises:
a process mechanism configured to conduct a predetermined process for the sheet; and
a transfer mechanism configured to transfer the process mechanism;
wherein the sheet process apparatus further comprises:
a memory part configured to store both a plurality of position information on the process mechanism and a reference position of the code;
a camera configured to image the code printed on the sheet fed by the feed unit; and
a control unit configured to control an operation of the transfer mechanism;
wherein the control unit comprises:
an acquisition part configured to acquire an image data of the code imaged by the camera;
a read part configured to read information of the code from the image data acquired by the acquisition part;
a position measure part configured to measure a real position of the code from the image data acquired by the acquisition part;
a retrieval part configured to retrieve the position information corresponding to the information of the code read by the acquisition part, from a plurality of the position information on the process mechanism stored in the memory part;
a calculation part configured to calculate an amount of deviation between the real position of the code measured by the position measure part and the reference position of the code stored in the memory part;
a determination part configured to correct the position information on the process mechanism retrieved by the retrieval part on the basis of the amount of deviation calculated by the calculation part so as to determine a target position of the process mechanism; and
a target position output part configured to output the target position of the process mechanism determined by the determination part toward the transfer mechanism; and
wherein the transfer mechanism transfers the process mechanism toward the target position of the process mechanism output from the target position output part;
wherein the position measure part comprises:
an outline recognition part configured to recognize an outline of the code on the basis of the image data; and
a coordinate measure part configured to measure a coordinate of predetermined one point on the outline of the code recognized by the outline recognition part;
wherein the predetermined one point is disposed on one corner of the outline of the code;
wherein the coordinate measure part is con figured to sub-pixel process the image data acquired by the acquisition part within limited area of the one corner so as to measure a coordinate of the corner; and
wherein the position measure part comprises:
an angle measure part configured to measure an angle of a line connected with predetermined two points on the outline of the code recognized by the outline recognition part;
a judge part configured to judge whether the angle measured by the angle measure part is more than a predetermine angle; and
a stop signal output part configured to output a signal for stopping the sheet process apparatus when the judge part judges that the angle is more than the predetermined angle.

2. The sheet process apparatus according to claim 1, wherein the predetermined two points are disposed on two corners of the outline of the code, and wherein the angle measure part is configured to sub-pixel process the image data acquired by the acquisition part within limited areas of the two corners so as to measure the angle of the line connected with the two corners.

3. The sheet process apparatus according to claim 1, wherein the sheet process apparatus is composed of a sheet cut apparatus, and wherein the process mechanism comprises a slitter.

4. The sheet process apparatus according to claim 1, wherein the sheet process apparatus is composed of a sheet fold apparatus, and wherein the process mechanism comprises a stopper disposed on a buckle.

5. A control method for a sheet process apparatus,
wherein the sheet process apparatus comprises:
a feed unit configured to feed a plurality of sheets one-by-one; and
a process unit configured to process one-by-one the sheets fed by the feed unit;
wherein the sheet comprises:
a one or two-dimensional code printed on a first or second surface thereof;
wherein the process unit comprises:
a process mechanism configured to conduct a predetermined process for the sheet; and
a transfer mechanism configured to transfer the process mechanism;
wherein the sheet process apparatus further comprises;
a memory part configured to store both, a plurality of position information on the process mechanism and a reference position of the code;
a camera configured to image the code printed on the sheet fed by the feed unit; and
a control unit configured to control an operation of the transfer mechanism;
wherein the control method comprises:
a first step of acquiring an image data of the code imaged by the camera;
a second step of reading information of the code from the image data acquired by the first step;
a third step of measuring a real position of the code from the image data acquired by the first step;

a fourth step of retrieving the position information corresponding to the information of the code read by the second step, from a plurality of the position information on the process mechanism stored in the memory part;

a fifth step of calculating an amount of deviation between the real position of the code measured by the third step and the reference position of the code stored in the memory part;

a sixth step of correcting the position information on the process mechanism retrieved by the fourth step on the basis of the amount of deviation calculated by the fifth step so as to determine a target position of the process mechanism;

a seventh step of outputting the target position of the process mechanism determined by the sixth step toward the transfer mechanism; and an eighth step of transferring the process mechanism toward the target position of the process mechanism output front the target position output part outputted by the seventh step; and wherein the third step comprises:

a tenth step of recognizing an outline of the code on the basis of the image data; and an eleventh step of measuring a coordinate of predetermined one point on the outline of the code recognized by the tenth step;

wherein the predetermined one point is disposed on one corner of the outline of the code;

wherein the eleventh step is configured to sub-pixel process the image data acquired by the first step within limited area of the one corner so as to measure a coordinate of the corner; and wherein the third step comprises:

a twelfth step of measuring an angle of line connected with predetermined two points on the outline of the code recognized by the tenth step;

a thirteenth step of judging, whether the angle measured by the twelfth step is more than a predetermined angle; and a fourteenth step of outputting a signal for stopping the sheet process apparatus when the judge part judges that the angle is more than the predetermined angle in the thirteenth step.

6. The control method for the sheet process apparatus according to claim 5, wherein the predetermined two points are disposed on two corners of the outline of the code, and wherein the twelfth step is configured to sub-pixel process the image data acquired by the first step within limited areas of the two corners so as to measure the angle of the line connected with the two corners.

7. The control method for the sheet process apparatus according to claim 5, wherein the sheet process apparatus is composed of a sheet cut apparatus, and wherein the process mechanism comprises a slitter.

8. The control method for the sheet process apparatus according to claim 5, wherein the sheet process apparatus is composed of a sheet fold apparatus, and wherein the process mechanism comprises a stopper disposed on a buckle.

* * * * *